US005499418A

United States Patent [19]

Tan et al.

[11] Patent Number: 5,499,418

[45] Date of Patent: Mar. 19, 1996

[54] BODY SUPPORT FOR A BABY

[76] Inventors: Sze W. Tan; Valerie A. Capper, both of 18-B Iverson Road, London NW6 2HE, Great Britain

[21] Appl. No.: 240,779

[22] PCT Filed: Nov. 25, 1992

[86] PCT No.: PCT/GB92/02173

§ 371 Date: Jun. 22, 1994

§ 102(e) Date: Jun. 22, 1994

[87] PCT Pub. No.: WO93/10695

PCT Pub. Date: Jun. 10, 1993

[30] Foreign Application Priority Data

| | | | |
|---|---|---|---|
| Nov. 25, 1991 | [GB] | United Kingdom | 9125013 |
| Feb. 12, 1992 | [GB] | United Kingdom | 9202952 |
| Jun. 25, 1992 | [GB] | United Kingdom | 9213489 |

[51] Int. Cl.[6] ..... A47C 20/02

[52] U.S. Cl. ..... 5/655; 5/922

[58] Field of Search ..... 5/655, 422, 652, 5/603, 637, 657, 632

[56] References Cited

U.S. PATENT DOCUMENTS

| | | | |
|---|---|---|---|
| 2,952,856 | 9/1960 | Ruff . | |
| 3,034,132 | 5/1962 | Lundsberger . | |
| 3,992,733 | 11/1976 | Racine | 5/652 |
| 4,274,673 | 6/1981 | Kifferstein | 5/490 |
| 4,506,396 | 3/1985 | Rithchie | 5/922 |
| 4,528,981 | 7/1985 | Behar | 5/922 |
| 4,631,765 | 12/1986 | Casey . | |
| 5,165,130 | 11/1992 | Wendling | 5/655 |
| 5,272,780 | 12/1993 | Clute | 5/655 |

FOREIGN PATENT DOCUMENTS

| | | | |
|---|---|---|---|
| 483941 | 2/1970 | Switzerland | 5/922 |

*Primary Examiner*—Flemming Saether
*Attorney, Agent, or Firm*—Larson & Taylor

[57] ABSTRACT

A body support for a young child or a baby having a pair of bolster cases containing bolsters, the first bolster case being connected to one end of a flexible sheet connector and the second bolster case being connected to the other end of a flexible sheet connector. A pair of mating releasable fastening material strips are mounted to the first bolster case and the flexible sheet connector such that the first bolster case may be rolled under a portion of the flexible sheet connector. Thus, the flexible sheet connector is adjustably attached to the first bolster case and the distance between the first and second bolster cases is infinitely adjustable.

4 Claims, 1 Drawing Sheet

BODY SUPPORT FOR A BABY

Figure 1:
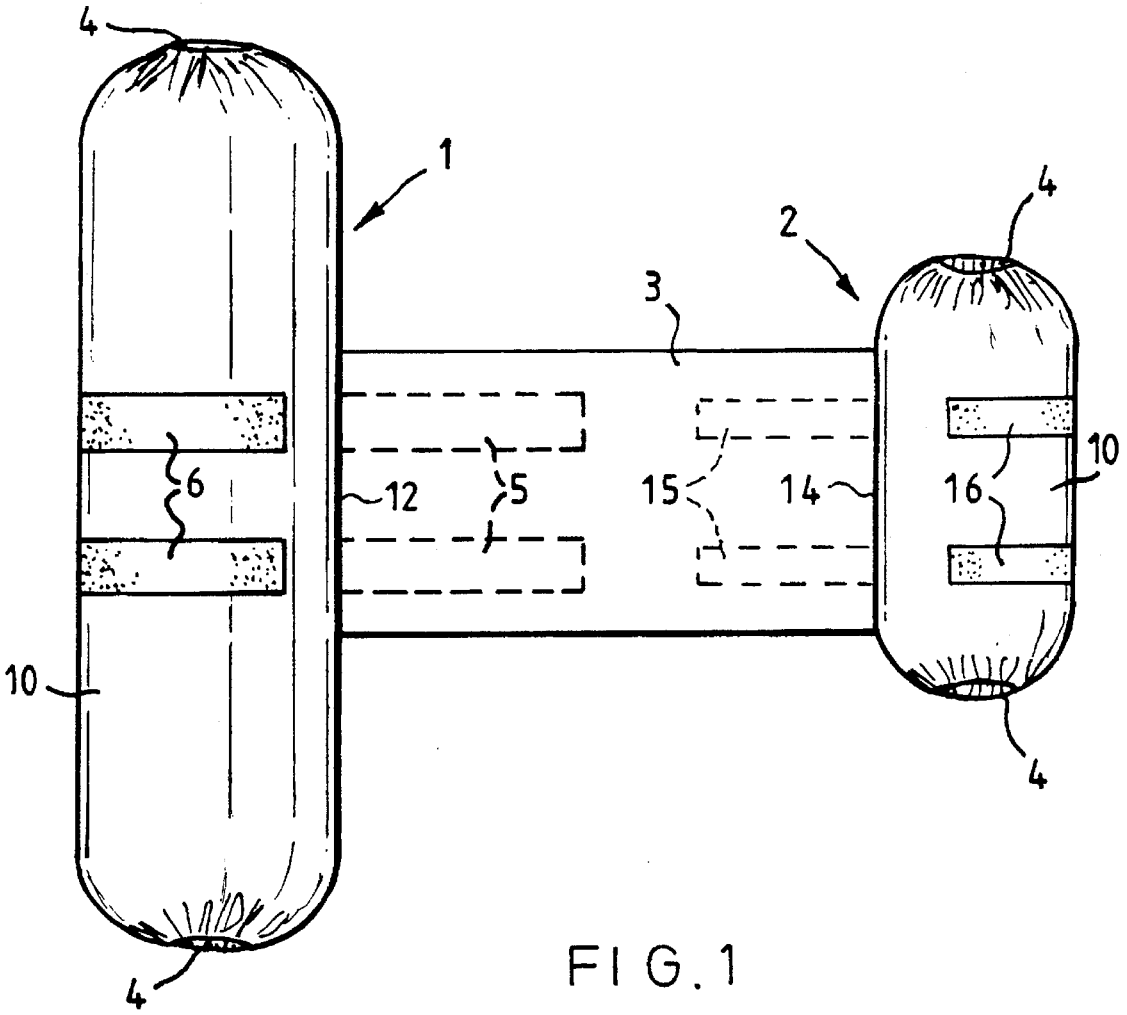

This invention relates to a body support which enables a baby or young child to sleep safely on its side.

Sudden Infant Death Syndrome (SIDS) or "cot death" as it is commonly known, has been acknowledged for many years. The causes of SIDS are mostly unexplained and the associated risk factors have still to be defined. However, the medical professions generally agree that one of the likely contributory factors to SIDS is the bedding and sleeping position of the young baby.

Parents are often concerned as to what is the best position for laying down a sleeping baby. A baby sleeping on its back faces the risk of choking on its vomit. A baby lying on its front can inhale dangerous toxic gases created by fungus development on the cover of the cot mattress. A baby sleeping on its side would be less susceptible to such unnecessary risks. The present invention sets out to provide a device which serves to position a baby comfortably and securely upon its side.

Although parents may lay their babies in the desired side position, it has been found that only 30 percent such babies remain in that position and many move to a prone position with their face downwards and such babies face a higher risk of cot death.

Many parents use rolled-up towels or blankets, one for the front and one for the back, to keep their babies in the side position. Spontaneous movements by babies including stretching and kicking may lead to the front rolled-up towel to end up partially or completely covering the baby's head, leading to overheating and possibly suffocation. Pillows used in place of towels or blankets are an improvement.

U.S. Pat. No. 2,765,480 discloses an all purpose orthopedic pillow comprising a pair of equal size pillows with a connecting band with snap fasteners for detachably connecting one or both pillows to the band. These snap fasteners allow the pillow to be used for various purposes with one or both of the sets of snap fasteners engaged. This type of snap fastener only allows a pillow case to be secured completely to the band or to be not secured to the band and there is no adjustment of the proportion of the band which is secured to the adjacent pillow case.

According to the present invention there is provided a body support for a young child or baby comprising a pair of bolster cases permanently interconnected by means of a length of flexible connector means, a bolster in each case and means for adjusting the effective length of the connector means between one bolster case and the other by selectively connecting lengths of the flexible connector to bolster case. This adjustment means may include a continuous strip fastener, such as that made under the trademark Velcro where a plurality of hooks are mounted on a continuous strip or by a plurality of snap fasteners. In either case, lengths of the connector starting from the junction of the connector with the bolster case are releasably fastened to the case, the remainder of the connector governing the separation of the bolsters.

Each bolster may simply be the filling of the case or may be a removable pad, which is preferable for hygenic reasons.

The connector means may take any convenient form. Preferably it consists of a length of fabric having opposite ends attached to the respective bolsters. It may be such as to keep the bolsters substantially parallel to one another, and accordingly may for example comprise two or more tapes or cords each extending between the two bolsters, and spaced along the length of the bolsters.

The length of the connector means will be chosen for the range of baby sizes with which the support is to be used. Any part of the connector means not required is removed from the effective length, for example by rolling around one or other of the bolster cases and being fastened thereto by the fasteners if provided. This means there will be a tangential connection between the effective length of the connector and the bolster case. The wrapped-around part of the connector is preferably only at the baby's back so that there is no possibility of the front bolster becoming unwrapped due to movement of the baby.

The bolsters may be of equal lengths. However, bolsters of unequal lengths may provide more comfortable and securer positioning of the baby, the shorter bolster being placed at the front and the longer bolster at the rear of the baby's body.

Figure 2:
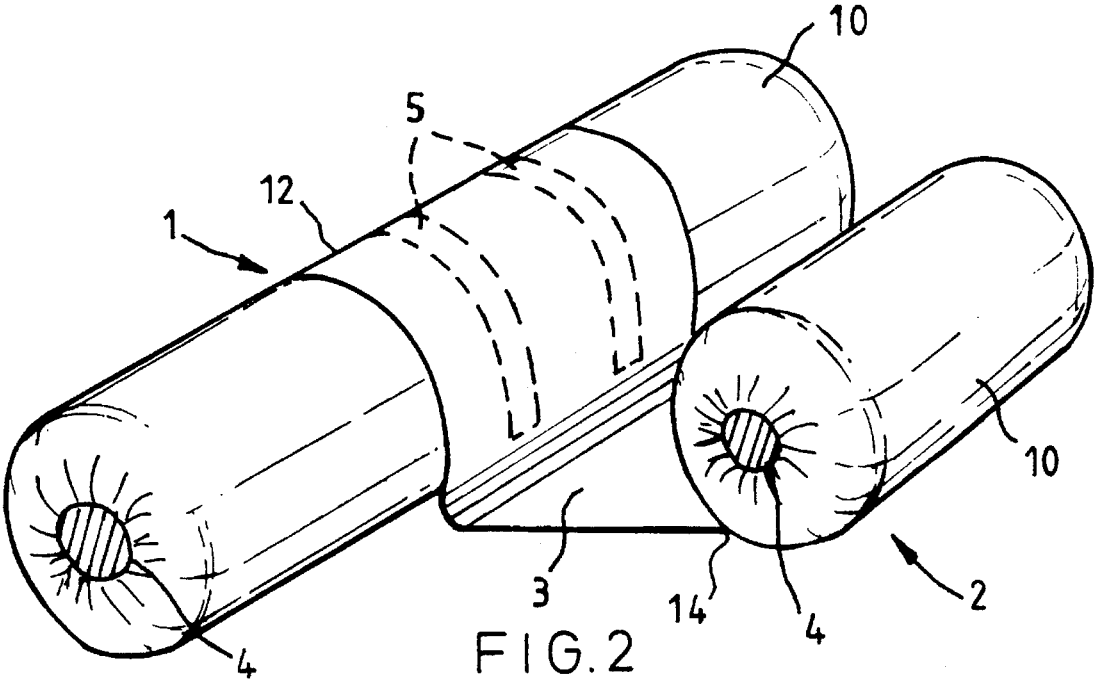

An embodiment of the present invention will now be described by way of example and with reference to the accompanying drawings in which:

FIG. 1 is a plan view of a body support in accordance with a first embodiment of the present invention, and FIG. 2 is a perspective view of the body support of FIG. 1 in a position suitable for supporting a young baby.

The illustrated body support comprises two generally cylindrical cushioned bolsters 1 and 2 each clothed by a respective bolster cover 10. One of the bolsters 1 is relatively longer than the other 2. The bolster covers are connected by a single sheet of fabric 3, which is joined to the side of each case and tends to align the bolsters with their axes parallel. Sheet 3 is joined to bolster 1 at joint 12 and sheet 3 is joined to bolster 2 at joint 14. Strips 5 of one side of a hook-and-loop releasable fastening material (such as that sold under the Trade Mark Velcro) are mounted on the underside of the sheet 3 and strips 6 of the mate side of the hook-and-loop releasable fastening material are mounted on the case of the bolster 1 so that the effective length of the sheet 3 can be reduced by rolling the bolster 1 under the sheet 3 towards the bolster 2 so that its case is fastened to part of the sheet 3. The support is shown in its partially rolled-up state in FIG. 2.

In this embodiment, the longer bolster 1 is of such a length as to provide support for the back of a sleeping baby, but should not, in use, extend above the baby's shoulder, in order that the baby can incline its head backwards for better respiration. The smaller bolster 2 should not be longer than the average baby's trunk, thus allowing for movement of arms and legs.

The bolster covers 10 are generally cylindrical and each is open at one or both of its ends. Each bolster pad is retained within its respective cover by means of one or two elasticated bands 4, one of which is situated at each respective open end of each cover 10 and serves to close the opening. Each band is simply flexed to enable removal of the respective bolster.

In order to use the support to support a baby lying on its side, the baby is placed on the sheet 3 with its front against the bolster 2. The rear bolster is rolled along the underside of the sheet 3 until it supports the baby's back, which is the arrangement illustrated in FIG. 2. The strip fasteners 5 and 6 prevent the bolster 1 unrolling in response to pressures from the baby, although of course it can be released back to its fully extended position as shown in FIG. 1 if sufficient pressure is applied to release the strip fastener material 5 and 6.

The strips 5 have been shown on the undersurface of the sheet 3, but could be on the upper side. The illustrated arrangement has the advantage that the rear bolster 1 is less likely to unroll in response to pressures from the baby lying on the sheet 3 than if the strips 5 were on the upper side.

The device can be used to lay a child on either its left or its right side of the body simply by reversing the placing of the bolsters.

In an alternative embodiment of the invention, not illustrated, the bolsters are of equal length; preferably these bolsters should both be the length of the shorter bolster shown in the above embodiment otherwise limb movement and/or respiration of the baby could be restricted.

Although it is preferable that the bolsters be provided in covers or cases, as described above, since this facilitates washing and cleaning of the support, it is possible for the cases to constitute the bolsters by simply being provided with filling material.

The bolsters/cases are filled with materials which comply with the appropriate Health and Safety Standards.

The cylindrical shape of the bolsters is the preferred shape because it is economical in space and particularly comfortable for the baby or small child to use. It is not, however, intended that the expression "bolster" be limited to this particular shape of cushion and the bolsters may be given any particular shape or configuration which serves to suitably cushion the baby securely and comfortably. Indeed, it is possible to design a bolster to have a shape which closely matches the body contours of the baby.

Each bolster is preferably so filled that the surface of the bolster is firm and does not sag. However, as an alternative, the bolster may be filled with a bead-like particulate material which serves to enable the bolster to adapt to the shape and/or size of the baby.

The bolsters may be porous, to allow air to easily pass through the bolster bodies, thus reducing the risk of suffocation.

It is not necessary for the bolsters and bolster covers to be sold or provided together. For hygienic or other purposes, it may be desirable to provide separate covers and bolsters. This arrangement allows bolsters and covers to be interchanged and/or replaced for aesthetic reasons or for washing, for example. Furthermore bolsters can be replaced easily or exchanged for bolsters having different characteristics, to avoid allergic reaction, for example.

Although two Velcro strips 15 are provided on the sheet and strips 6 are provided on the bolster cover 10 of the longer bolster 1, strips 16 could alternatively, or additionally, be provided on the bolster cover of the shorter bolster 2 for mating with strips 15 provided on the sheet 3. Obviously, if bolster covers are not to be used, strips can be mounted directly on a respective bolster or bolsters.

It will be seen that the two strips 5 and 6 extend in the direction of the length of the sheet 3, both on the sheet 3 and on the bolster cover 10 respectively. It is not necessary for two strips to be provided on the sheet and corresponding two on one or more of the bolsters. A single sheet of Velcro attachment could be used or a larger number of strips could be used.

The bolsters or covers may also be provided with decorative surface patterns or formations designed to be attractive to the baby. For example, the bolsters or covers may be provided with the heads of teddy-bears, or the bolsters may have ends shaped to resemble soft toys, in particular animals' or dolls' heads, animals' tails, etc.

What is claimed is:

1. A body support for a young child or baby comprising:

a first bolster case and a second bolster case;

a flexible sheet having two ends and a center portion, each end being permanently connected to one of said first and second bolster cases;

a bolster in said first bolster case and a bolster in said second bolster case, said bolsters being substantially cylindrical in shape;

a first strip of releasable fastening material mounted on said sheet and a second strip of releasable fastening material mounted on said first bolster case, said first strip of releasable fastening material being the fastening mate of said second strip of releasable fastening material, said strips of releasable fastening material being positioned for adjustably connecting said center portion of said sheet to said first bolster case when said first bolster case is rolled under said sheet such that the distance between said first and second bolster cases is infinitely adjustable.

2. A support as claimed in claim 1 wherein each said bolster is detachably mounted within its respective said bolster case.

3. A support as claimed in claim 1 wherein one said bolster is longer than the other said bolster.

4. A support as claimed in claim 1 wherein a third strip of releasable fastening material that is the mate of said first strip of releasable fastening material is mounted on said second bolster case for further adjusting the distance between said first and second bolster cases.

* * * * *